US005637043A

United States Patent [19]

Fortis

[11] Patent Number: 5,637,043

[45] Date of Patent: Jun. 10, 1997

[54] GOLF CLUB GRIP

[75] Inventor: J. Gerald Fortis, Chicago, Ill.

[73] Assignee: Ram Golf Corporation, Melrose Park, Ill.

[21] Appl. No.: 592,998

[22] Filed: Jan. 29, 1996

[51] Int. Cl.[6] ..... A63B 53/14

[52] U.S. Cl. ..... 473/302; 473/303

[58] Field of Search ..... 473/300, 301, 473/302, 303; 273/75

[56] References Cited

U.S. PATENT DOCUMENTS 1,587,082 6/1926 Mattern ..... 473/302

2,446,622 8/1948 Turner ..... 473/302

2,468,202 4/1949 Karns ..... 473/300

4,974,846 12/1990 Fenton ..... 473/303

*Primary Examiner*—Sebastiano Passaniti

*Attorney, Agent, or Firm*—Rudnick & Wolfe

[57] ABSTRACT

A grip for positioning on the handle portion of a golf club shaft, the grip comprising a tubular member defining an inside surface for engagement with the exterior surface of the shaft, and an exterior surface engageable by the hands of a golfer, the exterior surface defining a plurality of X-shaped grooves located in spaced-apart relationship over substantially the entirety of the exterior surface.

4 Claims, 1 Drawing Sheet

GOLF CLUB GRIP

BACKGROUND OF THE INVENTION

This invention relates to an improved grip for golf clubs. In particular, the invention concerns a unique pattern formed in the exterior surface of the grip which provides a highly effective "feel" for the club when holding the club during the golf swing.

The "feel" of a club in the golfers hands has always been considered important. Fundamentally, a secure and comfortable feeling when gripping a club is translated into more effective use of the club when striking a golf ball. This is due in part to the fact that if a secure and comfortable grip is not achieved, the club could twist on impact when a ball is struck. In addition, any discomfort could cause the golfer to change from the best hand position on the club which would also lead to poor results when hitting the ball.

In addition to such purely physical factors, it is known that a good "feel" when gripping a golf club can improve the golfer's mental attitude. The nature of the game of golf allows for considerable thinking about each shot as opposed to fast-paced games requiring more instinctive reactions. A secure and comfortable feeling when gripping a golf club will therefore tend to place the golfer in a better frame of mind for executing a golf shot.

Golf grip design efforts have resulted in many variations in patterns formed in the exterior surfaces of golf grips. It is recognized, however, that improvements in this area are always welcomed by the golfing public.

SUMMARY OF THE INVENTION

This invention comprises a grip positioned on the handle portion of a golf club shaft. In typical fashion, the grip constitutes a tubular member having an inside surface bonded to the shaft and an exterior surface for engagement by the hands of a golfer.

The exterior surface of the grip of this invention is provided with a plurality of X-shaped grooves. The grooves are located substantially completely over this surface from the top to the bottom of the grip so that the golfers hands engage many such X-shaped grooves. The feel experienced by the golfer upon such engagement constitutes a significant improvement when compared with other grip designs.

It is preferred that the X-shaped grooves be formed on the external surface in a precise pattern. Specifically, the grooves at a given vertical level form a circumferential band which is parallel with bands of grooves above and below. In addition, each X-shaped groove of one band forms part of a spiral line of such grooves extending from top to bottom of the grip.

DETAILED DESCRIPTION OF THE ILLUSTRATED EMBODIMENTS

1. The Prior Art.

Figure 1:
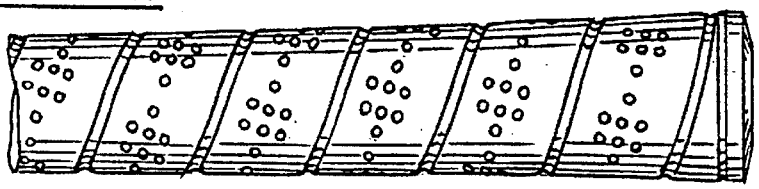
FIG. 1 PRIOR ART
FIG. 1 is a fragmentary elevational view of one form of prior art grip design.
Figure 2:
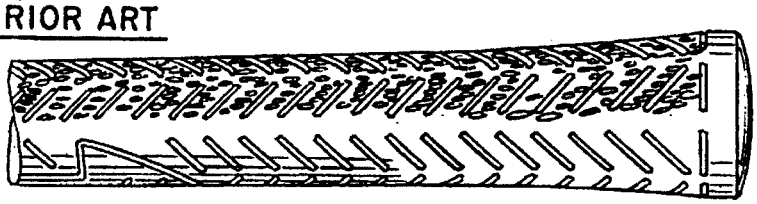
FIG. 2 PRIOR ART
FIG. 2 is a fragmentary elevational view of a second form of prior art grip design.
Figure 3:
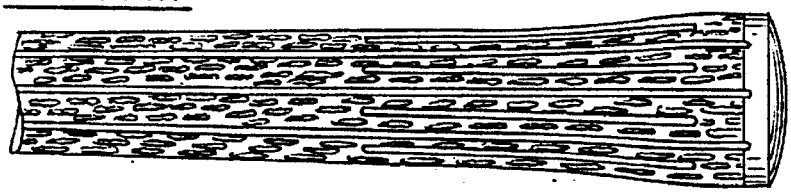
FIG. 3 PRIOR ART
FIG. 3 is a fragmentary elevational view of a third form of prior art grip design.

FIGS. 1–3 illustrate typical grip designs of the prior art. The grip 10 is a form often used for leather grips wherein the grip material is spirally wound around the club shaft from a strip of material. This results in a spiral groove 12 which enhances gripping action, and patterns of holes 14 may also be included for this purpose.

The grip design of FIG. 1 may also be made into a tubular sleeve before attachment to the club shaft. In either case, an adhesive of some sort is employed for bonding the inside surface of the grip material to the exterior surface of the shaft.

FIGS. 2 and 3 illustrate prior art grip designs typically formed of a synthetic rubber material such as EPDM (ethylene, propylene, diene monomer). These grips are manufactured in a tubular form and are stretchable so that when fitted over the handle end of a golf club shaft, and in combination with an adhesive, a secure attachment is achieved.

The grip 16 of FIG. 2 employs grooves 18 in a "chevron" pattern with a view toward enhancing feel. FIG. 3 illustrates another prior art option wherein vertically extending grooves 20 are formed from top to bottom along the grip 22. Each of the grips of FIGS. 2 and 3 also includes interspersed fabric pieces 24 which have been included with many prior art designs.

2. The Invention

Figure 4:
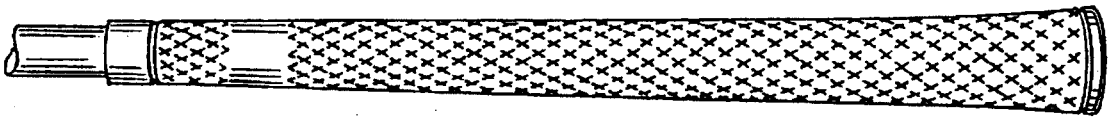
FIG. 4 is a fragmentary elevational view of a grip design in accordance with the invention.

FIG. 4 illustrates the grip 30 which is characterized by the concepts of this invention. The grip is mounted on the handle portion of shaft 32 between top cap 34 and plastic band 36 which are conventionally employed.

The grip 30 defines a plurality of X-shaped grooves 38 formed in its external surface for engagement by the golfer's hands. A blank area 40 may be provided for applying a manufacturer's logo or other identifying information. This area is located outside the area normally gripped by the golfer.

Figure 5:
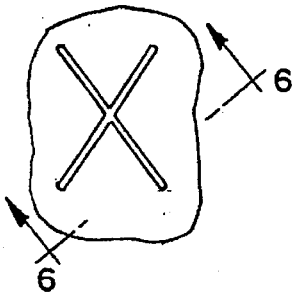
FIG. 5 is an enlarged fragmentary plan view illustrating the X-shaped groove configuration of the grip design of FIG. 4; and, FIG. 6 is an enlarged fragmentary cross-sectional view of a groove taken about the line 6—6 of FIG. 5.
Figure 6:
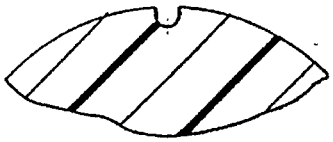

The details of the X-shaped grooves 38 are shown in FIGS. 4 and 5. As shown, each groove has a lateral extent "a" and a vertical extent "b". In accordance with the invention, the lateral dimension varies between 0.075 and 0.135 inches with 0.085 inches being one typical dimension and 0.125 comprising another example for this dimension. The vertical dimension preferably varies from 0.115 to 0.135 inches with 0.125 inches being a typical dimension.

The lateral groove dimension may be substantially constant, however, a variation in this lateral dimension may be achieved due to the fact that the grip stretches more at the top than at the bottom because of the gradual decrease in shaft diameter from top to bottom. Accordingly, a lateral dimension of 0.125 inches may characterize the grooves at the top, and this dimension will gradually decrease to 0.085 inches at the bottom.

The X-shaped grooves 38 preferably have a maximum depth of between about 0.015 and 0.025 inches with 0.022 inches being typical. A groove width of between about 0.020 and 0.030 inches, with 0.025 inches being typical, is employed.

As shown in FIG. 4, the X-shaped grooves 38 are located in discrete circumferential bands. Each band is parallel to the other bands from top to bottom of the grip. In addition, it will be noted that the individual X-shaped grooves in a band are angularly disposed relative to the grooves in adjacent bands whereby a plurality of spiral lines of such grooves from top to bottom of the grip.

As shown, the individual X-shaped grooves 38 are relatively small and are closely spaced. In the latter connection, the dimension "c" shown in FIG. 4 is intended to illustrate a typical spacing between a portion of one X-shaped groove and the closest portion of an adjacent groove. This spacing will vary between about 0.010 and 0.050 inches with 0.025 inches being typical.

From 10 to 16 X-shaped grooves 38 are included in each circumferential band with 13 such grooves being typical. From 50 to 70 bands, for example 60 bands, extend from top to bottom of a grip which is typically about 10½ inches long.

The grip achieved in accordance with the teachings of this invention has excellent comfort and "feel" characteristics. In addition, the grip readily accomplishes the basic attribute of a secure relationship between the golfer's hands and the grip surfaces. Furthermore, the grip design is efficiently achieved in a manufacturing process.

It will be understood that various changes may be made in the grip design of this invention without departing from the spirit of the invention particularly as defined in the following claims.

That which is claimed is:

1. A grip for positioning on the handle portion of a golf club shaft, said grip comprising a tubular member defining an inside surface for engagement with the exterior surface of said shaft, and an exterior surface engageable by the hands of a golfer, said exterior surface defining a plurality of X-shaped grooves located in spaced-apart relationship over substantially the entirety of said exterior surface, said grooves extending from said exterior surface to a depth of between 0.015 and 0.025 inch, and have a maximum groove width of between 0.020 and 0.030 inch, each X-shaped groove having a lateral dimension of between 0.075 and 0.135 inch and a vertical dimension of between 0.115 and 0.135 inch, and wherein said grooves are formed in a plurality of spirally shaped rows, each row starting at a top of the grip and extending to a bottom of the grip, and each row extending parallel relative to every other row, said lateral dimension varying from a largest dimension at the top of the grip to a smallest dimension at the bottom of the grip, and wherein the most closely spaced-apart portions of any two adjacent X-shaped grooves are spaced apart between about 0.010 and 0.050 inch.

2. A grip according to claim 1 wherein said grooves are formed in a plurality of circumferential rows, the rows being positioned in vertically spaced apart relationship from top to bottom of said grip.

3. A grip according to claim 1 wherein said grooves extend from said exterior surface to a depth of about 0.022 inch and have a width of about 0.025 inch, and wherein said X-shape has a lateral dimension of about 0.085 inch and a vertical dimension of about 0.125 inch.

4. A grip according to claim 1 wherein said grooves extend from said exterior surface to a depth of about 0.022 inch and have a width of about 0.025 inch, and wherein said X-shape has a lateral dimension of about 0.125 inch and a vertical dimension of about 0.125 inch.

* * * * *